US012590351B2

(12) United States Patent
Yue et al.

(10) Patent No.: US 12,590,351 B2
(45) Date of Patent: Mar. 31, 2026

(54) PRODUCTION METHOD FOR NON-ORIENTED SILICON STEEL AND NON-ORIENTED SILICON STEEL

(71) Applicants: INSTITUTE OF RESEARCH OF IRON AND STEEL, JIANGSU PROVINCE/SHA-STEEL, CO. LTD (CN), Suzhou (CN); ZHANGJIAGANG YANGTZE RIVER COLD ROLLED PLATE CO. LTD, Suzhou (CN); JIANGSU SHAGANG GROUP CO., LTD., Suzhou (CN)

(72) Inventors: Chongxiang Yue, Suzhou (CN); Jiadong Lu, Suzhou (CN); Yanzhao Zhou, Suzhou (CN); Hualong Li, Suzhou (CN)

(73) Assignees: INSTITUTE OF RESEARCH OF IRON AND STEEL, JIANGSU PROVINCE/SHA-STEEL, CO. LTD (CN) CHINA, Suzhou (CN); ZHANGJIAGANG YANGTZE RIVER COLD ROLLED PLATE CO. LTD, Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 391 days.

(21) Appl. No.: 18/245,885

(22) PCT Filed: Aug. 4, 2021

(86) PCT No.: PCT/CN2021/110562
§ 371 (c)(1),
(2) Date: Mar. 17, 2023

(87) PCT Pub. No.: WO2022/062692
PCT Pub. Date: Mar. 31, 2022

(65) Prior Publication Data
US 2024/0011121 A1 Jan. 11, 2024

(30) Foreign Application Priority Data
Sep. 27, 2020 (CN) ..... 202011031589.3

(51) Int. Cl.
*C21D 8/1205* (2026.01)
*C21C 1/02* (2006.01)
(Continued)

(52) U.S. Cl.
CPC ..... *C21D 9/52* (2013.01); *C21C 1/02* (2013.01); *C21C 5/28* (2013.01); *C21C 7/0006* (2013.01);
(Continued)

(58) Field of Classification Search
CPC ..... C21D 8/12; C21D 8/1205; C21C 1/02; C21C 1/025; C21C 7/068; C21C 7/0685;
(Continued)

(56) References Cited

FOREIGN PATENT DOCUMENTS

CN 1190241 A 8/1998
CN 101082108 A 12/2007
(Continued)

OTHER PUBLICATIONS

Machine translation of CN104195427A (Jiangsu Inst Res Iron & Steel Sha Steel Co Ltd) to Guo Hairong et al., original document published on Dec. 10, 2014. (Year: 2014).*
(Continued)

*Primary Examiner* — Vanessa T. Luk
(74) *Attorney, Agent, or Firm* — Ladas & Parry, LLP

(57) ABSTRACT

A non-oriented silicon steel and a production method are provided. The non-oriented silicon steel is prepared by using
(Continued)

the processes of molten iron desulfurization, converter smelting, RH refining, continuous casting, hot rolling, acid tandem rolling, annealing, coating and finishing, and a chemical composition is as follows in mass percent:

C≤0.003%, S≤0.008%, Si: 0.35%+Δ1, Mn: 0.15-0.25%, P: 0.04-0.06%, Sn: 0.015%+Δ2, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions. The non-oriented silicon steel has the iron loss $P_{1.5/50}$≤5.5 W/kg and the magnetic induction intensity $B_{5000}$≥1.75 when having the thickness of 0.5 mm, and desulfurization is not needed in the RH refining process.

11 Claims, 3 Drawing Sheets

(51) Int. Cl.

| | |
|---|---|
| ***C21C 5/28*** | (2006.01) |
| ***C21C 7/00*** | (2006.01) |
| ***C21C 7/10*** | (2006.01) |
| ***C21D 1/74*** | (2006.01) |
| ***C21D 1/84*** | (2006.01) |
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C21D 8/1216*** | (2026.01) |
| ***C21D 8/1244*** | (2026.01) |
| ***C21D 9/52*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C23G 1/08*** | (2006.01) |

(52) U.S. Cl.

CPC ..... *C21C 7/10* (2013.01); *C21D 1/74* (2013.01); *C21D 1/84* (2013.01); *C21D 6/004* (2013.01); *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C21D 8/0278* (2013.01); *C21D 8/1205* (2013.01); *C21D 8/1222* (2013.01); *C21D 8/1261* (2013.01); *C22C 33/04* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C23G 1/08* (2013.01); *C22C 2202/02* (2013.01)

(58) Field of Classification Search

CPC ..... C21C 7/0006; C21C 7/04; C21C 7/064; C21C 7/0645

See application file for complete search history.

(56) References Cited

FOREIGN PATENT DOCUMENTS

| | | | | | |
|---|---|---|---|---|---|
| CN | 101333620 | A | | 12/2008 | |
| CN | 103014503 | A | | 4/2013 | |
| CN | 104195427 | A | | 12/2014 | |
| CN | 104762551 | A | | 7/2015 | |
| CN | 105256227 | A | | 1/2016 | |
| CN | 106048140 | A | * | 10/2016 | ..... C23C 8/18 |
| CN | 108286021 | A | | 7/2018 | |
| CN | 108474070 | A | | 8/2018 | |
| CN | 108504932 | A | | 9/2018 | |
| CN | 108660294 | A | | 10/2018 | |
| CN | 109252101 | A | | 1/2019 | |
| CN | 102676916 | A | | 9/2019 | |
| CN | 111057821 | A | | 4/2020 | |
| CN | 112143974 | A | | 12/2020 | |
| JP | H0463228 | A | | 2/1992 | |
| JP | 2003096548 | A | | 4/2003 | |
| JP | 2016222990 | A | | 12/2016 | |
| KR | 1020140084894 | | | 7/2014 | |

OTHER PUBLICATIONS

International Search Report in International application No. PCT/CN2021/110562 mailed on Oct. 29, 2021, with English translation provided by WIPO.

Written Opinion of the International Searching Authority in International application No. PCT/CN2021/110562 mailed on Oct. 29, 2021, with English translation provided by WIPO.

Gao, Chao et al.., Influence of Micro-alloy Elements Sn, Nb, Re on Properties of Non-Oriented Silicon Steel, Journal pf Hebei United University (Natural Science Edition), vol. 35, No. 03, Jul. 25, 2013, ISSN: 2095-2714, p. 27-30.

Gao, Chao et al., Influence of Micro-alloy Elements Sn, Nb, Re on Properties of Non-Oriented Silicon Steel, Journal of Hebei United University (Natural Science Edition), vol. 35, No. 03, Jul. 25, 2013, ISSN: 2095-2714, p. 27-30, with English translation provided by Google Translate.

* cited by examiner

PRODUCTION METHOD FOR NON-ORIENTED SILICON STEEL AND NON-ORIENTED SILICON STEEL

CROSS REFERENCE TO RELATED APPLICATIONS

The present application is the U.S. national phase of PCT Application No. PCT/CN2021/110562 filed on Aug. 4, 2021, which claims priority to Chinese Patent Application No. 202011031589.3, filed on Sep. 27, 2020 and titled "Production Method For Non-oriented Silicon Steel and Non-oriented Silicon Steel", the disclosures of which are incorporated herein by reference in their entireties.

TECHNICAL FIELD

The present disclosure belongs to the technical field of steel material preparation, relates to a production method for non-oriented silicon steel, and further relates to non-oriented silicon steel prepared by using the production method.

BACKGROUND

Non-oriented silicon steel is an iron core material for an electric motor and a generator rotor operating in a rotating magnetic field and is required to have a good magnetic property. Generally, in order to guarantee the magnetic property of the non-oriented silicon steel, the chemical composition is strictly controlled. When the non-oriented silicon steel is produced and prepared, an S element will be dissolved and precipitated in the form of MnS in steel to prevent grain growth during annealing and thus affect the magnetic property of a finished product, specifically, the magnetic induction intensity is reduced, and the iron loss is increased. Therefore, in the prior art, the chemical composition design and the production process of the non-oriented silicon steel generally pursues the ultra-low S control as a task goal.

Further, with regard to the ultra-low S chemical composition design of the non-oriented silicon steel, the steps of molten iron desulfurization, converter smelting and RH refining in the production process need to be strictly controlled correspondingly, the production cost thus remains high, and even the smooth operation of the working condition may be affected.

For example, in the RH refining step, a desulfurizer needs to be used to desulfurize molten steel, the desulfurizer makes contact with an impregnation pipe in an RH refining furnace with the circulation of the molten steel, and $CaF_2$ in the desulfurizer will react with CaO and $Al_2O_3$ in lining castables in the impregnation pipe to generate a low-melting-point substance $11CaO \cdot 7Al_2O_3 \cdot CaF_2$. The product is scoured by the molten steel and spalled off into the molten steel, i.e., the desulfurization treatment in the RH refining process may cause severe corrosion to the impregnation pipe in the RH refining furnace, resulting in the increase of the production cost and the adverse effect on the smooth operation of the working condition.

Therefore, it is worthy of developing a chemical composition design solution for the non-oriented silicon steel in the industrial production of the non-oriented silicon steel so as to satisfy the magnetic property of a low-grade product under the condition of relaxing the requirement on the S content.

SUMMARY

In order to solve the technical problem of high production cost of an ultra-low S chemical composition design solution for non-oriented silicon steel in the prior art, the present disclosure aims to provide a production method for non-oriented silicon steel, and further relates to non-oriented silicon steel prepared by using the production method.

In order to achieve the described objective of the present disclosure, an embodiment of the present disclosure provides a production method for non-oriented silicon steel. A finished product of the non-oriented silicon steel satisfying the following chemical composition design solution is prepared by using the processes of molten iron desulfurization, converter smelting, RH refining, continuous casting, hot rolling, acid tandem rolling, annealing, coating and finishing.

The chemical composition design solution is as follows in mass percent:

C≤0.003%, S≤0.008%, Si: 0.35%+Δ1, Mn: 0.15-0.25%, P: 0.04-0.06%, Sn: 0.015%+Δ2, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

when the molten steel reaches RH refining and satisfies S≤0.0030%, Δ1=Δ2=0;

when the molten steel reaches RH refining and satisfies 0.0030%≤S≤0.0045%, Δ1=0.05% and Δ2=0.005%;

when the molten steel reaches RH refining and satisfies 0.0045%<S≤0.0060%, Δ1=0.15% and Δ2=0.010%; and when the molten steel reaches RH refining and satisfies 0.0060%<S≤0.0075%, Δ1=0.25% and Δ2=0.020%.

Preferably, the finished product of the non-oriented silicon steel has the thickness of 0.500±0.005 mm, the iron loss $P_{1.5/50}$≤5.5 W/kg and the magnetic induction intensity $B_{5000}$≥1.75.

Preferably, in the molten iron desulfurization process:

the temperature of molten iron before desulfurization is controlled to be greater than or equal to 1350° C., the chemical composition is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%, the molten iron before desulfurization is desulfurized so as to control the temperature of the molten iron after desulfurization to be greater than or equal to 1320° C., and the S content in mass percent is less than or equal to 0.0015%;

in the converter smelting process:

the molten iron after desulfurization is mixed with scrap steel to be smelted in a converter; in the steel tapping process, sufficient tin ingots are added to steel tapping liquid according to the chemical composition base solution Δ1=Δ2=0 in the chemical composition design solution; after steel tapping is finished, a slag surface deoxidizer is added to the molten steel;

in the RH refining process:

the mass percent of S in the molten steel reaching RH refining is detected, and values of Δ1 and Δ2 in the chemical composition design solution are determined to obtain a final chemical composition solution; in the RH refining furnace to be vacuumized, decarburization is performed on the molten steel, then, according to the final chemical composition solution, ultra-low-titanium ferrosilicon, tin ingots, low-titanium ferrophosphorus and manganese metal are added to the molten steel, steel tapping is performed after net circulation for seven minutes; and the desulfurizer is not added in the RH refining process.

Preferably, in the molten iron desulfurization process, the slagging-off rate of the molten iron after desulfurization is controlled to be greater than or equal to 98%.

Preferably, in the converter smelting process, the addition of the scrap steel accounts for 20 to 25% of the total of the scrap steel and the molten iron; and in the steel tapping process, lime is added first, and then tin ingots are added.

Preferably, in the hot rolling process: a continuous casting billet is subjected to continuous casting billet heating, intermediate billet rolling, finish rolling and reeling in sequence to prepare a hot coil, where the continuous casting billet heating temperature is 1130 to 1160° C., the holding time is greater than or equal to 180 min, the intermediate billet thickness is 35 to 40 mm, the final rolling temperature is 865±15° C., the coiling temperature is 680° C.±20° C., and the hot coil thickness is 2.70±0.1 mm.

Preferably, in the acid tandem rolling process: after the hot coil prepared by hot rolling is pickled with HCl, rinsed and dried, cold rolling is performed to prepare a rolled hard coil, where the cold rolled reduction rate is 80 to 83%, and the rolled hard thickness is 0.501±0.005 mm.

Preferably, three-stage pickling is performed with HCl, where the first-stage concentration of an acid solution is 50 to 80 g/L, and the $Fe^{2+}$ concentration of the acid solution is less than or equal to 130 g/L; the second-stage concentration of the acid solution is 90 to 120 g/L, and the $Fe^{2+}$ concentration of the acid solution is less than or equal to 90 g/L; and the third-stage concentration of the acid solution is 140 to 160 g/L, and the $Fe^{2+}$ concentration of the acid solution is less than or equal to 50 g/L;

during pickling at each stage, the temperature of the acid solution is 75 to 85° C., a silicon steel pickling accelerator is added to the acid solution, and the silicon steel pickling accelerator accounts for 0.05 to 0.10% of the acid solution in percentage by weight; and the temperature of rinse water is 45 to 55° C., and the pickling and rinsing speed is controlled to be 100 to 180 mpm.

Preferably, in the annealing process: a steel belt of a cold hard coil is annealed in a mixed atmosphere of $H_2$ and $N_2$ in a continuous annealing furnace, the annealing temperature is 850±5° C., the annealing time is 60±5 seconds, and the annealed steel belt is cooled by using three-stage cooling, where:

the first-stage cooling is slow cooling of a high-temperature section, so that the steel belt is cooled to 800° C. from the annealing temperature at the cooling speed less than or equal to 5° C./s;

the second-stage cooling is circulating gas injection controlled cooling, so that the steel belt continues to be cooled to below 300° C. at the cooling speed less than or equal to 15° C./s; and the third-stage cooling is circulating water injection cooling, so that the steel belt continues to be cooled to below 100° C.

Preferably, in the coating and finishing process, coating and finishing are performed on the steel belt cooled to below 100° C. during annealing to obtain the finished product of the non-oriented silicon steel having the thickness of 0.500±0.005 mm.

An embodiment further provides non-oriented silicon steel. The non-oriented silicon steel is prepared by using the processes of molten iron desulfurization, converter smelting, RH refining, continuous casting, hot rolling, acid tandem rolling, annealing, coating and finishing. The non-oriented silicon steel is prepared from the following chemical components in mass percent:

C≤0.003%, S≤0.008%, Si: 0.35%+Δ1, Mn: 0.15-0.25%, P: 0.04-0.06%, Sn: 0.015%+Δ2, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

when the molten steel reaches RH refining and satisfies S≤0.0030%, Δ1=Δ2=0;

when the molten steel reaches RH refining and satisfies 0.0030%<S≤0.0045%, Δ1=0.05% and Δ2=0.005%;

when the molten steel reaches RH refining and satisfies 0.0045%<S≤0.0060%, Δ1=0.15% and Δ2=0.010%; and when the molten steel reaches RH refining and satisfies 0.0060%<S≤0.0075%, Δ1=0.25% and Δ2=0.020%.

In order to achieve the described objective of the present disclosure, an embodiment of the present disclosure provides non-oriented silicon steel and a production method for the non-oriented silicon steel. According to the method, a product of the non-oriented silicon steel having the thickness of 0.5±0.005 mm is prepared by using the processes of molten iron desulfurization, converter smelting, RH refining, continuous casting, hot rolling, acid tandem rolling, annealing, coating and finishing, and the product of the non-oriented silicon steel has the iron loss $P_{1.5/50}$≤5.5 W/kg and the magnetic induction intensity $B_{5000}$≥1.75, where in the molten iron desulfurization process:

the temperature of molten iron before desulfurization is controlled to be greater than or equal to 1350° C., the chemical composition is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%, the molten iron before desulfurization is desulfurized so as to control the temperature of the molten iron after desulfurization to be greater than or equal to 1320° C., and the S content in mass percent is less than or equal to 0.0015%;

in the converter smelting process:

the molten iron after desulfurization is mixed with scrap steel to be smelted in a converter; in the steel tapping process, sufficient tin ingots are added to steel tapping liquid according to the chemical composition base solution; after steel tapping is finished, a slag surface deoxidizer is added to the molten steel; and the chemical composition base solution is as follows in mass percent: C≤0.003%, S≤0.008%, Si: 0.35%, Mn: 0.15-0.25%, P: 0.04-0.06%, Sn: 0.015%, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

in the RH refining process:

in the RH refining furnace to be vacuumized, decarburization is performed on the molten steel;

then, alloying is performed according to the mass percent of S in the molten steel reaching RH refining, where when the molten steel reaches RH refining and satisfies S≤0.0030%, ultra-low-titanium ferrosilicon, low-titanium ferrophosphorus and manganese metal are added to the molten steel according to the chemical composition base solution; when the molten steel reaches RH refining and satisfies 0.0030%<S≤0.0045%, Si and Sn in the chemical composition base solution are adjusted to 0.40% and 0.020% respectively; when the molten steel reaches RH refining and satisfies 0.0045%<S≤0.0060%, Si and Sn in the chemical composition base solution are adjusted to 0.50% and 0.025% respectively; when the molten steel reaches RH refining and satisfies 0.0060%<S≤0.0075%, Si and Sn in the chemical composition base solution are adjusted to 0.60% and 0.035% respectively, and ultra-low-titanium ferrosilicon, tin ingots, low-titanium ferrophosphorus and manganese metal are added to the molten steel according to the adjusted chemical composition solution;

then, steel tapping is performed after net circulation for seven minutes; and the desulfurizer is not added in the RH refining process.

Compared with the prior art, the present disclosure has the beneficial effects:

(1) the finished product of the non-oriented silicon steel that is prepared by using the production method and has the thickness of 0.500±0.005 mm has the iron loss $P_{1.5/50}$≤5.5 W/kg and the magnetic induction intensity $B_{5000}$≥1.75, has excellent magnetic property, can satisfy the requirement of small and medium-sized motors on low-grade non-oriented silicon steel, has low production cost and promotes the smooth operation of the working condition;

(2) by controlling the contents of C, Nb, V, Ti, Mo, Cr, Ni, Cu and N elements and optimizing the corresponding relation between the Si and Sn contents and S, the upper limit of the S content can be relaxed to 0.0080%, i.e., S≤0.008% is controlled to be satisfied, on the basis of S≤0.008%, S>0.0050% and even ≥0.0060% can be allowed, the stability of the magnetic property of the non-oriented silicon steel is guaranteed, the instability of the magnetic property cannot be caused by the increased S content, and the stability of the yield is achieved;

(3) the magnetic property is guaranteed, and meanwhile, the contents of Mn and P elements are correspondingly designed, so that the strength and welding property of the non-oriented silicon steel are taken into account; and (4) in the production method, the difficulty in the required S content is lowered, the difficulty in S control in the processes of molten iron desulfurization, converter smelting and RH refining is lowered correspondingly, the requirement and cost of scrap steel during converter smelting are reduced, and the desulfurization is not needed in the RH refining process, so that the corrosion of the desulfurizer on the impregnation pipe of the RH refining furnace in the prior art is solved, the service life of the impregnation pipe of the RH refining furnace is prolonged, the production cost is reduced, and the influence of equipment damage on the sequence of the working condition is avoided.

DETAILED DESCRIPTION

Figure 1:
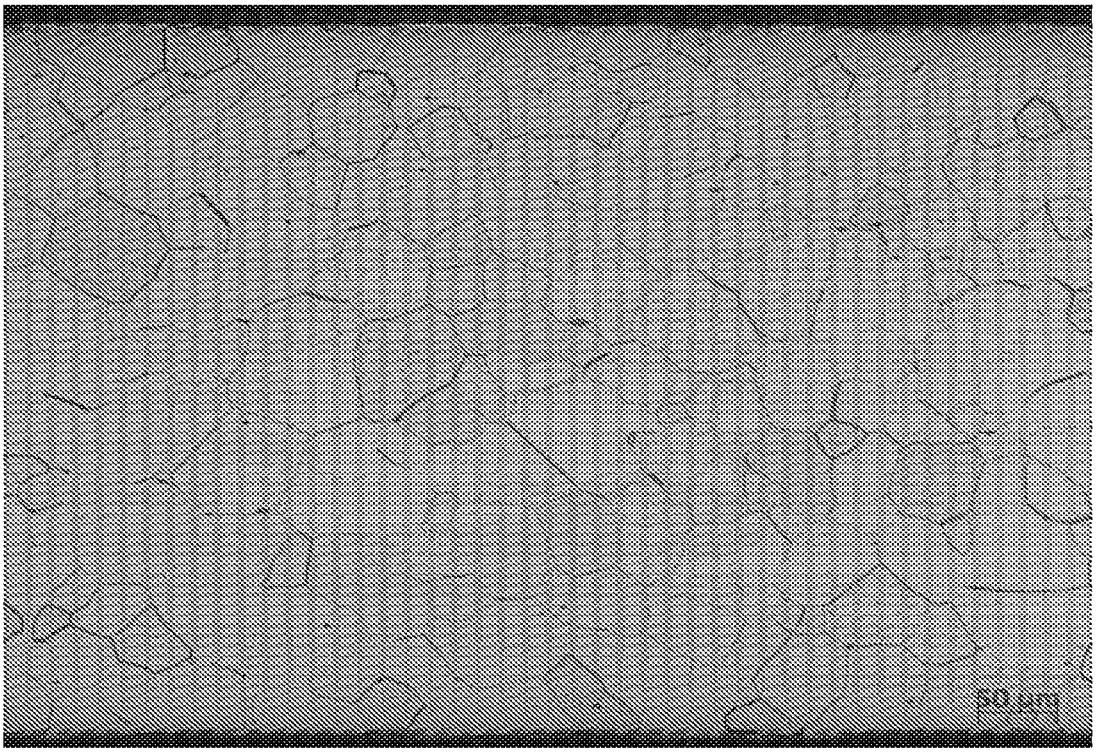
FIG. 1 is a metallographic micrograph of a finished sample of non-oriented silicon steel in Example 1 of the present disclosure.

An embodiment of the present disclosure provides a production method for non-oriented silicon steel. The production method comprises the following processes of molten iron desulfurization, converter smelting, RH refining, continuous casting, hot rolling, acid tandem rolling, annealing, coating and finishing in sequence. The embodiment further provides the non-oriented silicon steel prepared by using the production method, i.e., the non-oriented silicon steel is prepared by using the processes of molten iron desulfurization, converter smelting, RH refining, continuous casting, hot rolling, acid tandem rolling, annealing, coating and finishing.

The chemical composition design solution of the non-oriented silicon steel is as follows in mass percent: C≤0.003%, S≤0.008%, Si: 0.35%+Δ1, Mn: 0.15-0.25%, P: 0.04-0.06%, Sn: 0.015%+Δ2, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

when the molten steel reaches RH refining and satisfies S≤0.0030%, Δ1=Δ2=0; when the molten steel reaches RH refining and satisfies 0.0030%<S≤0.0045%, Δ1=0.05% and Δ2=0.005%; when the molten steel reaches RH refining and satisfies 0.0045%<S≤9-0.0060%, Δ1=0.15% and Δ2=0.010%; and when the molten steel reaches RH refining and satisfies 0.0060%<S≤0.0075%, Δ1=0.25% and Δ2=0.020%.

That is, according to the production method of the present disclosure, in the whole steelmaking process from molten iron desulfurization, converter smelting and RH refining till continuous casting, the contents of all the elements are controlled according to the described chemical composition design solution so as to prepare and obtain a continuous casting billet and the non-oriented silicon steel satisfying the described chemical composition design solution.

According to the mass percent of S in the molten steel reaching RH refining (that is, when the RH refining arrives, i.e., the molten steel enters the RH refining furnace but the process of RH refining is not started) and the corresponding relation between Δ1 and Δ2 and the S content of the molten steel, the mass percent of Si and Sn in the chemical composition design solution is adjusted so as to accurately control the contents of all the elements.

After detection, the finished product of the non-oriented silicon steel that is prepared by using the production method and has the thickness of 0.500±0.005 mm has the iron loss $P_{1.5/50}$≤5.5 W/kg and the magnetic induction intensity $B_{5000}$≥1.75, has excellent magnetic property, can satisfy the requirement of small and medium-sized motors on low-grade non-oriented silicon steel, has low production cost and promotes the smooth operation of the working condition;

All the elements in the chemical composition design solution are described as follows.

C, Nb, V, Ti, Mo, Cr, Ni, Cu and N: more of these elements are not favorable for grain growth in the annealing process, thus deteriorate the magnetic property of the non-oriented silicon steel and cause increased iron loss and decreased magnetic induction intensity, therefore, the low content is relatively good, such as C≤0.003%, Nb≤0.004%, V≤0.004%, Ti≤0.005%, Mo≤0.004%, Cr≤0.03%, Ni≤0.03%, Cu≤0.03% and N≤0.003%.

S: as described in the background, the S element is dissolved and precipitated in the form of MnS in steel to prevent grain growth during annealing and thus affect the magnetic property of the prepared finished product, and the prior art usually aims to achieve the ultra-low S content, such as below 0.0050%; however, by optimizing the corresponding relation between the Si and Sn contents and S, the upper limit of the S content can be relaxed to 0.0080%, i.e., S≤0.008% is controlled to be satisfied, on the basis of S≤0.008%, as shown in Examples 3 and 4 below, S>0.0050% and even ≥0.0060% can be also allowed.

Si: the Si content is controlled to be 0.35 to 0.60%, and the increased Si content can increase the resistivity and effectively reduce iron loss.

Sn: the Sn content is controlled to be 0.015 to 0.035%, Sn is a grain-boundary segregation element, and the increased Sn content in the non-oriented silicon steel can obviously reduce the proportion of an adverse {111} structure and increase the magnetic induction intensity of the finished produced.

Mn: the Mn content is controlled to be 0.15 to 0.25%, and hot shortness caused by S is inhibited while the magnetic property is guaranteed.

P: the P content is controlled to be 0.04 to 0.06%, the strength of the non-oriented silicon steel can be effectively increased, the punching property is increased, meanwhile, a good welding property is guaranteed, especially for the low-grade non-oriented silicon steel in the present disclosure, the Si content is relatively low, and the strengthening effect of P guarantees sufficient strength.

In general, according to the chemical composition design solution of the present disclosure, by controlling the contents of C, Nb, V, Ti, Mo, Cr, Ni, Cu and N elements and designing the contents of Si, Sn, Mn and P elements, a traditional technique is correspondingly broken, and the upper limit of the S content is relaxed to 0.0080%, so that the magnetic property, strength and welding property of the non-oriented silicon steel are guaranteed, meanwhile, the problems of high production cost and poor operation of the working condition caused by strict ultra-low S control in the prior art are solved, the production cost is reduced, and the smooth operation of the working condition is promoted.

Specifically, the processes of the production method of an embodiment are described in detail below.

(1) the Molten Iron Desulfurization Process

Desulfurization is performed on molten iron by using a KR desulfurization technique.

The temperature of the molten iron before desulfurization is controlled to be greater than or equal to 1350° C., and the chemical composition of the molten iron before desulfurization is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%.

The temperature of the molten iron after desulfurization is controlled to be greater than or equal to 1320° C., and the S content is less than or equal to 0.0015% in mass percent. That is, after the process of molten iron desulfurization is carried out, the S content of the molten iron is less than or equal to 0.0015% in mass percent.

Preferably, the slagging-off rate of the molten iron after desulfurization is controlled to be greater than or equal to 98%.

(2) the Converter Smelting Process

Steel tapping liquid (i.e., the molten iron after desulfurization) in the described molten iron desulfurization process of is transferred to a converter and mixed with scrap steel in the converter, and the molten iron after desulfurization and the scrap steel are smelted into molten steel in the converter. Preferably, the scrap steel can be clean scrap steel, and the addition of the scrap steel accounts for 20 to 25% of the total of the scrap steel and the molten iron.

In the steel tapping process, sufficient tin ingots are added to the steel tapping liquid according to the chemical composition base solution Δ1=Δ2=0 in the chemical composition design solution. Specifically, the chemical composition at Δ1=Δ2=0 in the chemical composition design solution can be regarded as a chemical composition base solution and comprises the following components in mass percent: C≤0.003%, S≤0.008%, Si: 0.35%, Mn: 0.15-0.25%, P: 0.04-0.06%, Sn: 0.015%, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions. According to the chemical composition base solution, the weight of the tin ingots needing to be added is calculated temporarily according to the Sn content of 0.015% in the final finished product of the non-oriented silicon steel, and sufficient tin ingots are added to the steel tapping liquid.

Here, the method for determining the weight of the tin ingots is taken as an example, the total amount of the molten steel in the converter smelting process is set to M1, the weight of the tin ingots needing to be added in the converter smelting process is set to M2, according to the base solution Δ1=Δ2=0, the weights of ultra-low-titanium ferrosilicon, low-titanium ferrophosphorus and manganese metal needing to be added in the subsequent process of RH refining are set to M3, M4 and M5, (M1+M2+M3+M4+M5) is used as the total amount of the molten steel, the weight M2 of the tin ingots is calculated according to 0.015% of Sn in the total amount of the molten steel, the weight M3 of the ultra-low-titanium ferrosilicon is calculated according to 0.35% of Si in the total amount of the molten steel, the weight M4 of the low-titanium ferrophosphorus is calculated according to 0.04 to 0.06% of P in the total amount of the molten steel, and the weight M5 of the manganese metal is calculated according to 0.15 to 0.25% of Mn in the total amount of the molten steel. It should be understood that in the calculating process, M3, M4 and M5 are roughly calculated according to the base solution and are temporary data only used for assisting to determine M2 but are not the actual amount added in the subsequent process of RH refining under certain conditions (for example, the subsequent RH refining arrives at S>0.0030%).

Preferably, in the steel tapping process, lime is added first, and then sufficient tin ingots are added, i.e., lime is added before tin ingots are added.

After steel tapping is finished, a slag surface deoxidizer is added to the molten steel.

(3) the RH Refining Process

The process is implemented in an RH refining furnace in a decarburization mode in the sequence of pre-vacuumizing, decarburization, alloying, net circulation and vacuum breaking.

The mass percent of S in the molten steel reaching RH refining is detected, and values of Δ1 and Δ2 in the chemical composition design solution are determined to obtain the final chemical composition solution and facilitate the control over the corresponding alloy addition during alloying.

Specifically, the molten steel satisfies S≤0.0075% when reaching RH refining. As mentioned above, when the molten steel reaches RH refining and satisfies S≤0.0030%, Δ1=Δ2=0, which corresponds to the chemical composition base solution at the moment, i.e., the continuous casting billet ultimately cast by the molten steel and the final finished product of the non-oriented silicon steel satisfy the chemical composition base solution.

When the molten steel reaches RH refining and satisfies 0.0030%<S≤0.0045%, Δ1=0.05% and Δ2=0.005%, which corresponds to the first design solution after adjustment at the moment: Si: 0.40%, and Sn: 0.020%; when the molten steel reaches RH refining and satisfies 0.0045%<S≤0.0060%, Δ1=0.15% and Δ2=0.010%, which corresponds to the second design solution after adjustment at the moment: Si: 0.50% and Sn: 0.025%; and when the molten steel reaches RH refining and satisfies 0.0060%<S≤0.0075%, Δ1=0.25% and Δ2=0.020%, which corresponds to the third design solution after adjustment at the moment: Si: 0.60% and Sn: 0.035%. The first design solution, the second design solution and the third design solution are all the final chemical composition solution after Si and Sn in the chemical composition base solution are adjusted, i.e., the continuous casting billet ultimately cast by the molten steel and the final finished product of the non-oriented silicon steel satisfy the final chemical composition solution.

In the RH refining furnace to be vacuumized, decarburization is performed on the molten steel to control the mass percent of C.

Then, according to the mass percent of S in the molten steel reaching RH refining, alloying is performed on the molten steel on the basis of the final chemical composition solution. Specifically, when the molten steel reaches RH refining and satisfies S≤0.0030%, ultra-low-titanium ferrosilicon, low-titanium ferrophosphorus and manganese metal are added to the molten steel according to the chemical composition base solution, i.e., M3, M4 and M5 calculated in the described converter smelting process; when the molten steel reaches RH refining and satisfies 0.0030%<S≤0.0045%, ultra-low-titanium ferrosilicon, tin ingots, low-titanium ferrophosphorus and manganese metal are added to the molten steel according to the first design solution after adjustment; when the molten steel reaches RH refining and satisfies 0.0045%<S≤0.0060%, ultra-low-titanium ferrosilicon, tin ingots, low-titanium ferrophosphorus and manganese metal are added to the molten steel according to the second design solution after adjustment; and when the molten steel reaches RH refining and satisfies 0.0060%<S≤0.0075%, ultra-low-titanium ferrosilicon, tin ingots, low-titanium ferrophosphorus and manganese metal are added to the molten steel according to the third design solution after adjustment.

According to the first design solution, the second design solution and the third design solution as described above, the addition of the ultra-low-titanium ferrosilicon is further increased, and the tin ingots are additionally added on the basis of the chemical composition base solution. With regard to the method for determining the addition of the ultra-low-titanium ferrosilicon, the tin ingots, the low-titanium ferrophosphorus and the manganese metal in the three design solutions, the first design solution is taken as an example below.

As mentioned above, the total amount of the molten steel in the converter smelting process is set to M1, the weight of tin ingots added in the converter smelting process is M2, thus, the weights of ultra-low-titanium ferrosilicon, tin ingots, low-titanium ferrophosphorus and manganese metal further needing to be added in the RH refining process according to the first design solution are respectively set to M3', M2', M4' and M5', (M1+M2+M3'+M2'+M4'+M5') is used as the total amount of the molten steel, the weight M2' of tin ingots needing to be additionally added at the moment is calculated according to 0.020% of Sn in the total amount of the molten steel (i.e., the mass percent of Sn in the finished product of the non-oriented silicon steel is 0.020%), the weight M3' of ultra-low-titanium ferrosilicon is calculated according to 0.40% of Si in the total amount of the molten steel (i.e., the mass percent of Si in the finished product of the non-oriented silicon steel is 0.40%), the weight M4' of low-titanium ferrophosphorus is calculated according to 0.04 to 0.06% of P in the total amount of the molten steel (i.e., the mass percent of P in the finished product of the non-oriented silicon steel is 0.04 to 0.06%), and the weight M5' of manganese metal is calculated according to 0.15 to 0.25% of Mn in the total amount of the molten steel (i.e., the mass percent of Mn in the finished product of the non-oriented silicon steel is 0.15 to 0.25%); and then, sufficient ultra-low-titanium ferrosilicon, tin ingots, low-titanium ferrophosphorus and manganese metal are respectively added to the molten steel according to calculation results.

After alloying, net circulation is performed for more than seven minutes, and then steel tapping is performed.

According to the present disclosure, the desulfurizer is not added in the RH refining process, i.e., the desulfurization in the RH refining process in the prior art is eliminated. It can be seen that by designing the chemical composition and improving the production method, the traditional technique is broken, and the upper limit of the S content is relaxed to 0.0080%, so that the magnetic property, strength and welding property of the non-oriented silicon steel are guaranteed, and the difficulty in S control in the processes of molten iron desulfurization, converter smelting and RH refining is lowered; and especially, the desulfurization is not needed in the RH refining process, so that the corrosion of the desulfurizer on the impregnation pipe of the RH refining furnace in the prior art is solved, the service life of the impregnation pipe of the RH refining furnace is prolonged, the production cost is reduced, and the influence of equipment damage on the sequence of the working condition is avoided.

(4) the Continuous Casting Process

The steel tapping liquid (i.e., the final molten steel after steel smelting is finished) in the RH refining process is prepared into the continuous casting billet by using continuous casting equipment. The specific operation of the continuous casting process can be realized by using an existing feasible continuous casting technique, and is not described in detail.

(5) the Hot Rolling Process

A continuous casting billet is subjected to continuous casting billet heating, intermediate billet rolling, finish rolling and reeling in sequence to prepare a hot coil.

The continuous casting billet heating temperature is 1130 to 1160° C., the holding time is greater than or equal to 180 min, and the intermediate billet thickness is 35 to 40 mm, so that the problems of long heating time, high rolling force, high production difficulty, low production efficiency and high production cost caused by low-temperature rolling are avoided, and meanwhile, MnS and other precipitates in steel are prevented from dissolving during heating by means of low-temperature rolling, thereby further guaranteeing the magnetic property of the finished product of the non-oriented silicon steel.

The final rolling temperature is 865±15° C. When the Si content is less than 1.7%, the austenite-ferrite phase change occurs in the hot rolling process. Generally, when the Si content is 0.35%, the phase change temperature is 880 to 910° C., and the phase change temperature increases as the Si content increases. Due to heat loss in the rolling process, the final rolling temperature is usually controlled between 80° and 920° C. In addition, due to high phase change temperature of high silicon steel, final rolling is performed 800 and 920° C. and is the ferrite rolling. Therefore, in order to obtain coarse grains, the higher final rolling temperature is required. However, for the non-oriented silicon steel of the present disclosure, the final rolling temperature being controlled to 865±15° C. can prevent a final rolling pass in an austenite area, thus prevent the magnetic property from deteriorating due to fine grains obtained by the phase change after rolling, and can guarantee that the final rolling pass is in the two-phase or ferrite rolling so as to guarantee the forming of coarse grains and optimize the magnetic property.

The coiling temperature is 680° C.±20° C., which is favorable for grain growth in the coiling process, improving the magnetic property and preventing oxidized scale difficult in pickling from forming.

The hot coil thickness is 2.70±0.1 mm, the hot rolling thickness affects the cold rolling deformation, the smaller the hot rolling thickness is, the less the cold rolling deformation is, and the bigger the obtained grains are.

(6) the Acid Tandem Rolling Process

After the hot coil prepared by hot rolling is pickled with HCl, rinsed and dried, cold rolling is performed to prepare a rolled hard coil, where the cold rolled reduction rate is 80 to 83%, and the rolled hard thickness is 0.501±0.005 mm.

Preferably, three-stage pickling is performed with HCl, where the first-stage concentration of an acid solution is 50 to 80 g/L, and the $Fe^{2+}$ concentration of the acid solution is less than or equal to 130 g/L; the second-stage concentration of the acid solution is 90 to 120 g/L, and the $Fe^{2+}$ concentration of the acid solution is less than or equal to 90 g/L; and the third-stage concentration of the acid solution is 140 to 160 g/L, and the $Fe^{2+}$ concentration of the acid solution is less than or equal to 50 g/L;

during pickling at each stage, the temperature of the acid solution is 75 to 85° C., a silicon steel pickling accelerator is added to the acid solution, and the silicon steel pickling accelerator accounts for 0.05 to 0.10% of the acid solution in percentage by weight; and the temperature of rinse water is 45 to 55° C., and the pickling and rinsing speed is controlled to be 100 to 180 mpm.

(7) the Annealing Process

A steel belt of a cold hard coil is annealed in a mixed atmosphere of $H_2$ and $N_2$ in a continuous annealing furnace, the annealing temperature is 850±5° C., the annealing time is 60±5 seconds, and the annealed steel belt is cooled by using three-stage cooling, where the first-stage cooling is slow cooling of a high-temperature section, so that the steel belt is cooled to 800° C. from the annealing temperature at the cooling speed less than or equal to 5° C./s; the second-stage cooling is circulating gas injection controlled cooling, so that the steel belt after the first-stage cooling is cooled to below 300° C. at the cooling speed less than or equal to 15° C./s; and the third-stage cooling is circulating water injection cooling, so that the steel belt after the second-stage cooling continues to be cooled to below 100° C.

The low cooling speed of the steel belt is favorable for reducing the cooling internal stress of a steel plate, but if the cooling section is too long, the production cost can be greatly increased. By using the described three-stage cooling control mode, the residual stress of the steel plate can be effectively controlled to be less than or equal to 50 MPa with low cost, which is favorable for controlling the plate shape.

(8) the Coating and Finishing Process

Coating and finishing are performed on the steel belt cooled to below 100° C. during annealing to obtain the final finished product of the non-oriented silicon steel having the thickness of 0.500±0.005 mm. The specific operation of the coating and finishing process can be realized by using an existing feasible coating and finishing technique, and is not described in detail. By accurately control the hot coil thickness, the rolled hard thickness (i.e., the thickness after acid tandem rolling) and the thickness of the finished product, the stability of the magnetic property is improved.

Compared with the prior art, the beneficial effects of the present disclosure lies in (1) the finished product of the non-oriented silicon steel that is prepared by using the production method and has the thickness of 0.500±0.005 mm has the iron loss $P_{1.5/50} \leq 5.5$ W/kg and the magnetic induction intensity $B_{5000} \geq 1.75$, has excellent magnetic property, can satisfy the requirement of small and medium-sized motors on low-grade non-oriented silicon steel, has low production cost and promotes the smooth operation of the working condition;

(2) by controlling the contents of C, Nb, V, Ti, Mo, Cr, Ni, Cu and N elements and optimizing the corresponding relation between the Si and Sn contents and S, the upper limit of the S content can be relaxed to 0.0080%, i.e., S≤0.008% is controlled to be satisfied, on the basis of S≤0.008%, as shown in Examples 3 and 4 below, S>0.0050% and even ≥0.0060% can be allowed, the stability of the magnetic property of the non-oriented silicon steel is guaranteed, the instability of the magnetic property cannot be caused by the increased S content, and the stability of the yield is achieved;

(3) the magnetic property is guaranteed, and meanwhile, the contents of Mn and P elements are correspondingly designed, so that the strength and welding property of the non-oriented silicon steel are taken into account; and (4) in the production method, the difficulty in the required S content is lowered, the difficulty in S control in the processes of molten iron desulfurization, converter smelting and RH refining is lowered correspondingly, the requirement and cost of scrap steel during converter smelting are reduced, and the desulfurization is not needed in the RH refining process, so that the corrosion of the desulfurizer on the impregnation pipe of the RH refining furnace in the prior art is solved, the service life of the impregnation pipe of the RH refining furnace is prolonged, the production cost is reduced, and the influence of equipment damage on the sequence of the working condition is avoided.

The detailed description listed above is only the specific description of the feasible embodiment of the present disclosure, and is not intended to limit the protection scope of the present disclosure. Any equivalent embodiment or modification without deviating from the spirit of the technique of the present disclosure shall fall within the protection scope of the present disclosure.

The outstanding progress of the embodiment is further described with reference to four examples in accordance with the embodiment and one comparative example not in accordance with the embodiment. Certainly, the four examples are only part of multiple variation examples in the embodiment, and are not all of the examples.

Specifically, the four examples and the comparative example both provide non-oriented silicon steel. The production method for the non-oriented silicon steel comprises the following processes of molten iron desulfurization, converter smelting, RH refining, continuous casting, hot rolling, acid tandem rolling, annealing, coating and finishing in sequence.

The respective chemical composition (i.e., the chemical composition of the steel tapping liquid during RH refining/the chemical composition of the continuous casting billet) of the non-oriented silicon steel in the four examples and the comparative example is shown in Table 1 in mass percent after sampling and detection. In the production process of the four examples and the comparative example, the mass percent of S in the molten steel reaching RH refining refers to Table 1.

TABLE 1

| | RH arrival (%) | Chemical composition (%) | | | | | | | | | | | | | |
|---|---|---|---|---|---|---|---|---|---|---|---|---|---|---|---|
| | S | C | S | Si | Mn | P | Sn | Nb | V | Ti | Mo | Cr | Ni | Cu | N |
| Example 1 | 0.0022 | 0.0021 | 0.0024 | 0.34 | 0.22 | 0.053 | 0.014 | 0.002 | 0.001 | 0.002 | 0.001 | 0.01 | 0.01 | 0.01 | 0.0015 |
| Example 2 | 0.0035 | 0.0025 | 0.0038 | 0.41 | 0.19 | 0.048 | 0.021 | 0.001 | 0.002 | 0.002 | 0.001 | 0.01 | 0.02 | 0.01 | 0.0018 |
| Example 3 | 0.0052 | 0.0022 | 0.0051 | 0.53 | 0.21 | 0.052 | 0.026 | 0.002 | 0.001 | 0.001 | 0.001 | 0.02 | 0.01 | 0.01 | 0.0017 |
| Example 4 | 0.0067 | 0.0018 | 0.0065 | 0.59 | 0.22 | 0.053 | 0.033 | 0.001 | 0.001 | 0.002 | 0.002 | 0.01 | 0.01 | 0.01 | 0.0021 |
| Comparative Example 1 | 0.0064 | 0.0022 | 0.0066 | 0.36 | 0.20 | 0.055 | 0.016 | 0.002 | 0.001 | 0.001 | 0.002 | 0.01 | 0.01 | 0.02 | 0.0018 |

Figure 2:
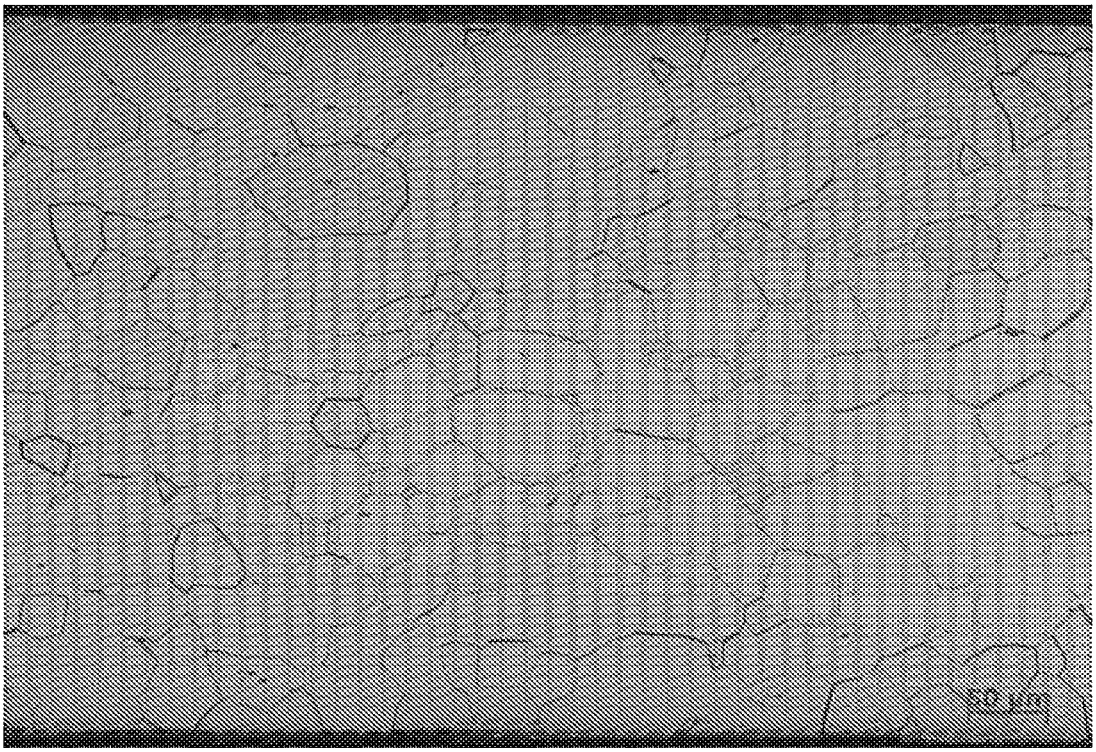
FIG. 2 is a metallographic micrograph of a finished sample of non-oriented silicon steel in Example 2 of the present disclosure.
Figure 3:
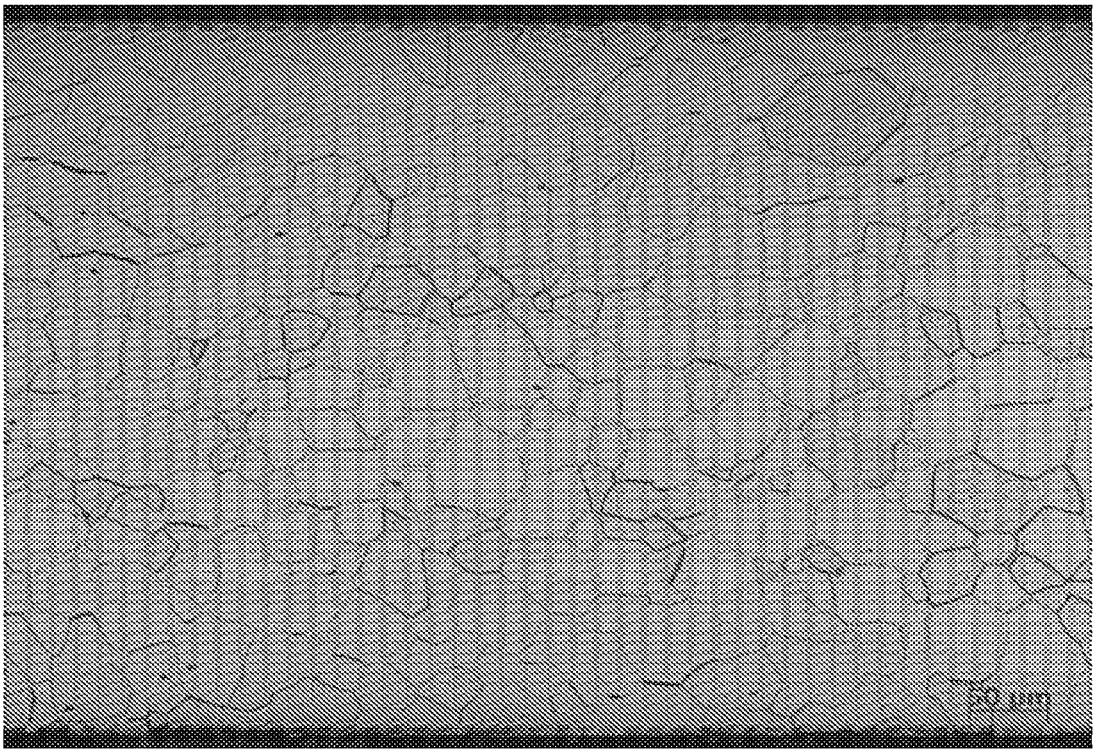
FIG. 3 is a metallographic micrograph of a finished sample of non-oriented silicon steel in Example 3 of the present disclosure.
Figure 4:
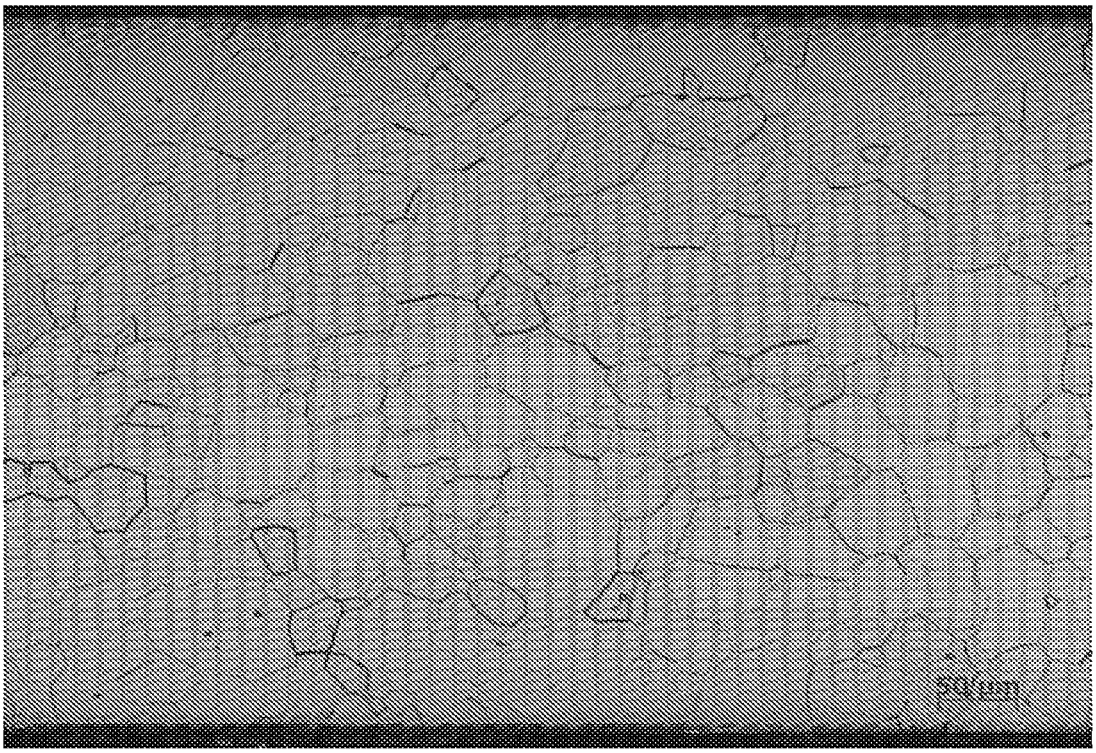
FIG. 4 is a metallographic micrograph of a finished sample of non-oriented silicon steel in Example 4 of the present disclosure.
Figure 5:
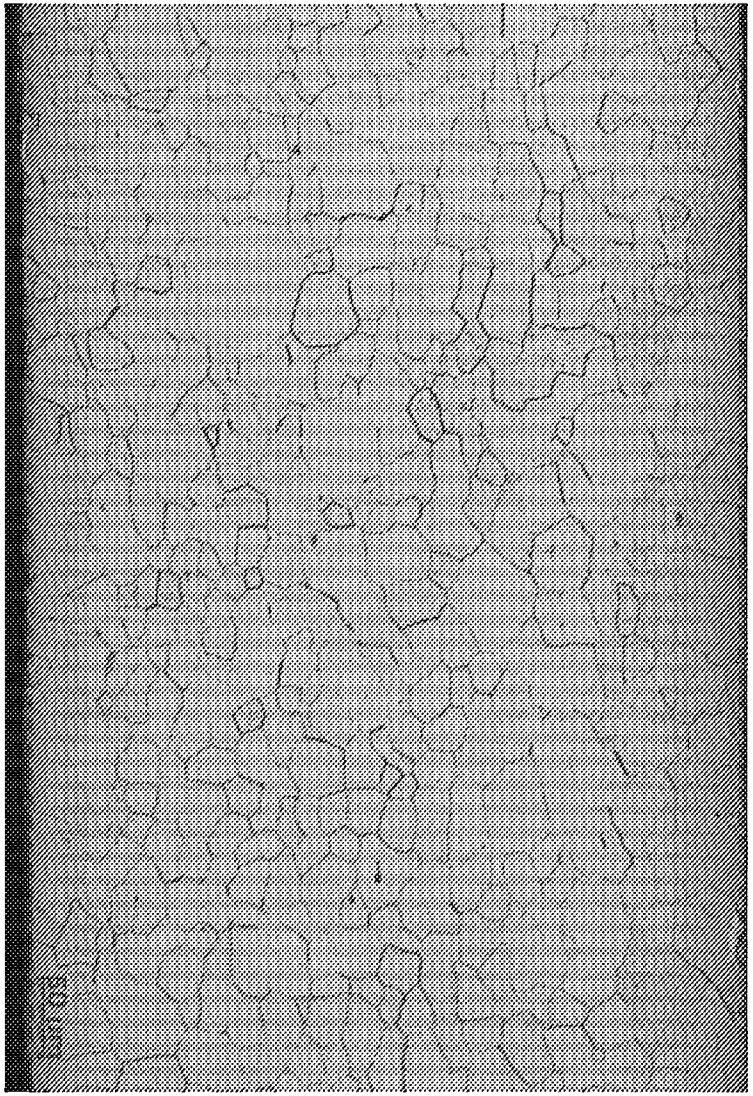
FIG. 5 is a metallographic micrograph of a finished sample of non-oriented silicon steel in Comparative Example 1 of the present disclosure.

Further, in the Examples 1-4 and the Comparative Example 1, the thickness of the finished product, the iron loss and the magnetic induction intensity of the prepared non-oriented silicon steel are shown in Table 2. The metallographic micrographs of the non-oriented silicon steel respectively refer to FIG. 1 to FIG. 5.

TABLE 2

| | Finished product | | |
|---|---|---|---|
| Example | Thickness (mm) | Iron loss $P_{1.5/50}$ (w/kg) | Magnetic induction intensity $B_{5000}$ (T) |
| Example 1 | 0.502 | 5.25 | 1.767 |
| Example 2 | 0.499 | 5.31 | 1.759 |
| Example 3 | 0.500 | 5.36 | 1.763 |
| Example 4 | 0.501 | 5.41 | 1.765 |
| Comparative Example 1 | 0.499 | 5.84 | 1.741 |

The Examples 1-4 are compared with the Comparative Example 1. It can be seen that in an embodiment, according to the S content of the molten steel reaching RH refining, the chemical composition is designed, ultra-low-titanium ferrosilicon and tin ingots are additionally added during alloying in the RH refining process, grains in the metallographic structure of the prepared non-oriented silicon steel are relatively coarse, and the non-oriented silicon steel has the iron loss $P_{1.5/50} \leq 5.5$ W/kg and the magnetic induction intensity $B_{5000} \geq 1.75$ when having the thickness of 0.5 mm, which is superior to the magnetic property of the Comparative Example 1.

Specifically, the production process of the Examples 1-4 and the Comparative Example 1 is as follows:

(1) the Molten Iron Desulfurization Process

In the Examples 1-4 and the Comparative Example 1, the molten iron desulfurization process comprises the steps of controlling the temperature of the molten iron before desulfurization to be greater than or equal to 1350° C., where the chemical composition of the molten iron before desulfurization is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%; and controlling the temperature of the molten iron after desulfurization to be greater than or equal to 1320° C., and the S content in mass percent is less than or equal to 0.0015%, and the slagging-off rate is controlled to be greater than or equal to 98%.

(2) the Converter Smelting Process

In the Examples 1-4 and the Comparative Example 1, the converter smelting process comprises the steps of transferring steel tapping liquid (i.e., the molten iron after desulfurization) in the described molten iron desulfurization process to a converter and mixing with cleaning scrap steel in the converter, where the addition of the scrap steel accounts for 20 to 25% of the total of the scrap steel and the molten iron, and the molten iron after desulfurization and the scrap steel are smelted into molten steel in the converter; adding lime first in the steel tapping process, and adding sufficient tin ingots to the steel tapping liquid according to 0.015% of Sn in the final finished product of the non-oriented silicon steel; and adding a slag surface deoxidizer to the molten steel after steel tapping is finished.

(3) the RH Refining Process

In the Examples 1-4 and the Comparative Example 1, the RH refining process comprises the steps of treating in a decarburization mode in the sequence of pre-vacuumizing, decarburization, alloying, net circulation and vacuum breaking, performing net circulation for more than seven minutes after alloying, and then performing steel tapping, where a desulfurizer is not added in the RH refining process, i.e., the desulfurization is not performed.

The Examples 1-4 differ from the Comparative Example 1 in the converter smelting process only in that:

- in Example 1, as shown in Table 1, the molten steel satisfies S≤0.0030% when reaching RH refining, ultra-low-titanium ferrosilicon, low-titanium ferrophosphorus and manganese metal are added to the molten steel according to 0.35% of Si, 0.04 to 0.06% of P and 0.15 to 0.25% of Mn in the final finished product of the non-oriented silicon steel, and the mass percent of the actual chemical composition of the steel tapping liquid in the RH refining process refers to Table 1;
- in Example 2, as shown in Table 1, the molten steel satisfies 0.0030%<S≤0.0045% when reaching RH refining, ultra-low-titanium ferrosilicon, tin ingots, low-titanium ferrophosphorus and manganese metal are added to the molten steel according to 0.40% of Si, 0.020% of Sn, 0.04 to 0.06% of P and 0.15 to 0.25% of Mn in the final finished product of the non-oriented silicon steel, and the mass percent of the actual chemical composition of the steel tapping liquid in the RH refining process refers to Table 1;
- in Example 3, as shown in Table 1, the molten steel satisfies 0.0045%<S≤0.0060% when reaching RH refining, ultra-low-titanium ferrosilicon, tin ingots, low-titanium ferrophosphorus and manganese metal are added to the molten steel according to 0.50% of Si, 0.025% of Sn, 0.04 to 0.06% of P and 0.15 to 0.25% of Mn in the final finished product of the non-oriented silicon steel, and the mass percent of the actual chemical composition of the steel tapping liquid in the RH refining process refers to Table 1;

in Example 4, the molten steel satisfies 0.0060%<S≤0.0075% when reaching RH refining, ultra-low-titanium ferrosilicon, tin ingots, low-titanium ferrophosphorus and manganese metal are added to the molten steel according to 0.60% of Si, 0.035% of Sn, 0.04 to 0.06% of P and 0.15 to 0.25% of Mn in the final finished product of the non-oriented silicon steel, and the mass percent of the actual chemical composition of the steel tapping liquid in the RH refining process refers to Table 1; but in the Comparative Example 1, although the molten steel satisfies 0.0060%<S≤0.0075% when reaching RH refining, ultra-low-titanium ferrosilicon, low-titanium ferrophosphorus and manganese metal are added to the molten steel according to 0.35% of Si, 0.04 to 0.06% of P and 0.15 to 0.25% of Mn in the final finished product of the non-oriented silicon steel, and the mass percent of the actual chemical composition of the steel tapping liquid in the RH refining process refers to Table 1.

(4) the Continuous Casting Process

In the Examples 1-4 and the Comparative Example 1, the continuous casting process comprises the step of preparing the steel tapping liquid in the RH refining process into the continuous casting billet by using continuous casting equipment.

(5) the Hot Rolling Process

In the Examples 1-4 and the Comparative Example 1, the hot rolling process comprises the step of enabling the continuous casting billet to be subjected to continuous casting billet heating, intermediate billet rolling, finish rolling and reeling in sequence to prepare a hot coil.

Specific values of the heating temperature, holding time, intermediate billet thickness, final rolling temperature, coiling temperature and hot coil thickness of the respective continuous casting billet in the Examples 1-4 and the Comparative Example 1 refer to Table 3.

(6) the Acid Tandem Rolling Process

In the Examples 1-4 and the Comparative Example 1, the acid tandem rolling process comprises the steps of:

performing three-stage pickling with HCl on the hot coil obtained after hot rolling, where the first-stage concentration of an acid solution is 50 to 80 g/L, and the $Fe^{2+}$ concentration of the acid solution is less than or equal to 130 g/L; the second-stage concentration of the acid solution is 90 to 120 g/L, and the $Fe^{2+}$ concentration of the acid solution is less than or equal to 90 g/L; the third-stage concentration of the acid solution is 140 to 160 g/L, and the $Fe^{2+}$ concentration of the acid solution is less than or equal to 50 g/L; during pickling at each stage, the temperature of the acid solution is 75 to 85° C., a silicon steel pickling accelerator is added to the acid solution, and the silicon steel pickling accelerator accounts for 0.05 to 0.100 of the acid solution in percentage by weight;

rinsing and drying, and then performing cold rolling to prepare a rolled hard coil, where the temperature of rinse water is 45 to 55° C., and the pickling and rinsing speed is controlled to be 100 to 180 mpm. The cold rolled reduction rate and rolled hard thickness in the Examples 1-4 and the Comparative Example 1 refer to Table 3.

(7) the Annealing Process

In the Examples 1-4 and the Comparative Example 1, the annealing process comprises the steps of annealing a steel belt of a cold hard coil in a mixed atmosphere of $H_2$ and $N_2$ in a continuous annealing furnace, where the annealing temperature and the annealing time refer to Table 3 respectively; and cooling the annealed steel belt by using three-stage cooling, where the first-stage cooling is slow cooling of a high-temperature section, so that the steel belt is cooled to 800° C. from the annealing temperature at the cooling speed less than or equal to 5° C./s; the second-stage cooling is circulating gas injection controlled cooling, so that the steel belt after the first-stage cooling is cooled to below 300° C. at the cooling speed less than or equal to 15° C./s; and the third-stage cooling is circulating water injection cooling, so that the steel belt after the second-stage cooling continues to be cooled to below 100° C.

TABLE 3

| | Hot rolling | | | | | | Acid tandem rolling | | Annealing | |
|---|---|---|---|---|---|---|---|---|---|---|
| | Heating temperature (° C.) | Holding time (min) | Intermediate billet thickness (mm) | Final rolling temperature (° C.) | Coiling temperature (° C.) | Hot coil thickness (mm) | Rolled hard thickness (mm) | Cold rolled reduction rate (%) | Temperature (° C.) | Time (s) |
| Example 1 | 1130-1150 | 195 | 38 | 868 | 685 | 2.73 | 0.503 | 81.6 | 852 | 61 |
| Example 2 | 1130-1150 | 188 | 38 | 862 | 692 | 2.69 | 0.499 | 81.4 | 853 | 63 |
| Example 3 | 1130-1150 | 203 | 38 | 875 | 678 | 2.72 | 0.501 | 81.6 | 849 | 60 |
| Example 4 | 1130-1150 | 192 | 38 | 865 | 673 | 2.70 | 0.501 | 81.4 | 850 | 62 |
| Comparative Example 1 | 1130-1150 | 214 | 38 | 870 | 682 | 2.68 | 0.500 | 81.3 | 848 | 59 |

(8) The Coating and Finishing Process

In the Examples 1-4 and the Comparative Example 1, the coating and finishing process comprises the step of performing coating and finishing on the steel belt cooled to below 100° C. during annealing. The thickness of the final finished product of the non-oriented silicon steel refers to Table 2.

To sum up, it can be seen that by comparing the Examples 1-4 with the Comparative Example 1, the finished product of the non-oriented silicon steel that is prepared by using the production method of the embodiment and has the thickness of 0.500±0.005 mm has the iron loss $P_{1.5/50}$≤5.5 W/kg and the magnetic induction intensity $B_{5000}$≥1.75 and has excellent magnetic property; and the desulfurization is not needed in the RH refining process, so that the corrosion of the desulfurizer on the impregnation pipe of the RH refining furnace in the prior art is solved, the service life of the impregnation pipe of the RH refining furnace is prolonged, the production cost is reduced, and the influence of equipment damage on the sequence of the working condition is avoided.

It should be noted that the Examples 1-4 are only one example of the embodiment, this embodiment is not limited to implement necessarily according to the Examples 1-4. Any implementation different from the examples without deviating from the technical solution of the embodiment shall fall within the protection scope of the prevent invention.

What is claimed is:

1. A production method for non-oriented silicon steel, wherein a finished product of the non-oriented silicon steel is prepared by using the processes of molten iron desulfurization, converter smelting, RH refining, continuous casting, hot rolling, acid tandem rolling, annealing, coating and finishing;

the chemical composition design solution of the non-oriented silicon steel is as follows in mass percent:

C≤0.003%, S≤0.008%, Si: 0.35%+Δ1, Mn: 0.15-0.25%, P: 0.04-0.06%, Sn: 0.015%+Δ2, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

if the mass percent of sulfur in the molten steel that reaches the RH refining step is less than or equal to 0.0030%, then Δ1=Δ2=0;

if the mass percent of sulfur in the molten steel that reaches the RH refining step is more than 0.0030% and less than or equal to 0.0045%, then Δ1=0.05% and Δ2=0.005%;

if the mass percent of sulfur in the molten steel that reaches RH refining step is more than 0.0045% and less than or equal to 0.0060%, then Δ1=0.15% and Δ2=0.010%; and if the mass percent of sulfur in the molten steel that reaches RH refining step is more than 0.0060% and less than or equal to 0.0075%, then Δ1=0.25% and Δ2=0.020%.

2. The production method for the non-oriented silicon steel according to claim 1, wherein the finished product of the non-oriented silicon steel has the thickness of 0.500±0.005 mm, the iron loss $P_{1.5/50}$≤5.5 W/kg and the magnetic induction intensity $B_{5000}$≥1.75.

3. The production method for the non-oriented silicon steel according to claim 1, wherein in the molten iron desulfurization process:

the temperature of molten iron before desulfurization is controlled to be greater than or equal to 1350° C., the chemical composition is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%, the molten iron before desulfurization is desulfurized so as to control the temperature of the molten iron after desulfurization to be greater than or equal to 1320° C., and the S content in mass percent is less than or equal to 0.0015%;

in the converter smelting process:

the molten iron after desulfurization is mixed with scrap steel to be smelted in a converter; in a steel tapping process, sufficient tin ingots are added to steel tapping liquid according to a chemical composition base solution, for which Δ1=Δ2=0 in the chemical composition design solution; after steel tapping is finished, a slag surface deoxidizer is added to the molten steel;

in the RH refining process:

the mass percent of S in the molten steel reaching RH refining is detected, and values of Δ1 and Δ2 in the chemical composition design solution are determined to obtain a final chemical composition solution; in the RH refining furnace to be vacuumized, decarburization is performed on the molten steel, then, according to the final chemical composition solution, ultra-low-titanium ferrosilicon, tin ingots, low-titanium ferrophosphorus and manganese metal are added to the molten steel, steel tapping is performed after net circulation for seven minutes; and the desulfurizer is not added in the RH refining process.

4. The production method for the non-oriented silicon steel according to claim 3, wherein in the molten iron desulfurization process, the slagging-off rate of the molten iron after desulfurization is controlled to be greater than or equal to 98%.

5. The production method for the non-oriented silicon steel according to claim 3, wherein in the converter smelting process, the addition of the scrap steel accounts for 20 to 25% of the total of the scrap steel and the molten iron; and in the steel tapping process, lime is added first, and then tin ingots are added.

6. The production method for the non-oriented silicon steel according to claim 1, wherein in the hot rolling process: a continuous casting billet is subjected to continuous casting billet heating, intermediate billet rolling, finish rolling and reeling in sequence to prepare a hot coil, wherein the continuous casting billet heating temperature is 1130 to 1160° C., the holding time is greater than or equal to 180 min, the intermediate billet thickness is 35 to 40 mm, the final rolling temperature is 865±15° C., the coiling temperature is 680° C.±20° C., and the hot coil thickness is 2.70±0.1 mm.

7. The production method for the non-oriented silicon steel according to claim 6, wherein in the acid tandem rolling process: after the hot coil prepared by hot rolling is pickled with HCl, rinsed and dried, cold rolling is performed to prepare a rolled hard coil, wherein the cold rolled reduction rate is 80 to 83%, and a thickness of the rolled hard coil is 0.501±0.005 mm.

8. The production method for the non-oriented silicon steel according to claim 7, wherein three-stage pickling is performed with HCl, wherein the first-stage concentration of an acid solution is 50 to 80 g/L, and the $Fe^{2+}$ concentration of the acid solution is less than or equal to 130 g/L; the second-stage concentration of the acid solution is 90 to 120 g/L, and the $Fe^{2+}$ concentration of the acid solution is less than or equal to 90 g/L; the third-stage concentration of the acid solution is 140 to 160 g/L, and the $Fe^{2+}$ concentration of the acid solution is less than or equal to 50 g/L;

during pickling at each stage, the temperature of the acid solution is 75 to 85° C., a silicon steel pickling accelerator is added to the acid solution, and the silicon steel pickling accelerator accounts for 0.05 to 0.10% of the acid solution in percentage by weight; and the temperature of rinse water is 45 to 55° C., and the pickling and rinsing speed is controlled to be 100 to 180 mpm.

9. The production method for the non-oriented silicon steel according to claim 1, wherein in the annealing process: a steel belt of a cold hard coil is annealed in a mixed atmosphere of $H_2$ and $N_2$ in a continuous annealing furnace, the annealing temperature is 850±5° C., the annealing time is 60±5 seconds, and the annealed steel belt is cooled by using three-stage cooling, wherein:

the first-stage cooling is slow cooling of a high-temperature section, so that the steel belt is cooled to 800° C. from the annealing temperature at the cooling speed less than or equal to 5° C./s;

the second-stage cooling is circulating gas injection controlled cooling, so that the steel belt continues to be cooled to below 300° C. at the cooling speed less than or equal to 15° C./s; and the third-stage cooling is circulating water injection cooling, so that the steel belt continues to be cooled to below 100° C.

10. The production method for the non-oriented silicon steel according to claim 1, wherein in the coating and finishing process, coating and finishing are performed on the steel belt cooled to below 100° C. during annealing to obtain the finished product of the non-oriented silicon steel having the thickness of 0.500±0.005 mm.

11. A production method for the non-oriented silicon steel, wherein a product of the non-oriented silicon steel having the thickness of 0.5±0.005 mm is prepared by using the processes of molten iron desulfurization, converter smelting, RH refining, continuous casting, hot rolling, acid tandem rolling, annealing, coating and finishing, and the product of the non-oriented silicon steel has the iron loss $P_{1.5/50}$≤5.5 W/kg and the magnetic induction intensity $B_{5000}$≥1.75, wherein in the molten iron desulfurization process:

the temperature of molten iron before desulfurization is controlled to be greater than or equal to 1350° C., the chemical composition is as follows in mass percent: Si: 0.20-0.70%, S≤0.05%, Nb≤0.005%, V≤0.04%, Ti≤0.06%, Mo≤0.001%, Cr≤0.03%, Ni≤0.03% and Cu≤0.03%, the molten iron before desulfurization is desulfurized so as to control the temperature of the molten iron after desulfurization to be greater than or equal to 1320° C., and the S content in mass percent is less than or equal to 0.0015%;

in the converter smelting process:

the molten iron after desulfurization is mixed with scrap steel to be smelted in a converter; in a steel tapping process, sufficient tin ingots are added to steel tapping liquid according to the chemical composition base solution; after steel tapping is finished, a slag surface deoxidizer is added to the molten steel; and the chemical composition base solution is as follows in mass percent: C≤0.003%, S≤0.008%, Si: 0.35%, Mn: 0.15-0.25%, P: 0.04-0.06%, Sn: 0.015%, Nb≤0.004%, V≤0.004%, Ti≤0.005%, Mo≤0.004%, Cr≤0.03%, Ni≤0.03%, Cu≤0.03%, N≤0.003% and the balance of Fe and inevitable inclusions;

in the RH refining process:

in the RH refining furnace to be vacuumized, decarburization is performed on the molten steel;

then, alloying is performed according to the mass percent of S in the molten steel reaching RH refining, wherein if the mass percent of sulfur in the molten steel that reaches RH refining process is less than or equal to 0.0030%, ultra-low-titanium ferrosilicon, low-titanium ferrophosphorus and manganese metal are added to the molten steel according to the chemical composition base solution; if the mass percent of sulfur in the molten steel that reaches RH refining process is more than 0.0030% and less than or equal to 0.0045%0.0045%, Si and Sn in the chemical composition base solution are adjusted to 0.40% and 0.020% respectively; if the mass percent of sulfur in the molten steel that reaches RH refining process is more than 0.0045% and less than or equal to 0.0060%, Si and Sn in the chemical composition base solution are adjusted to 0.50% and 0.025% respectively; if the mass percent of sulfur in the molten steel that reaches RH refining process is more than 0.0060% and less than or equal to 0.0075%, Si and Sn in the chemical composition base solution are adjusted to 0.60% and 0.035% respectively, and ultra-low-titanium ferrosilicon, tin ingots, low-titanium ferrophosphorus and manganese metal are added to the molten steel according to the adjusted chemical composition solution;

then, steel tapping is performed after net circulation for seven minutes; and the desulfurizer is not added in the RH refining process.

* * * * *